US007762104B2

(12) United States Patent
Lin

(10) Patent No.: US 7,762,104 B2
(45) Date of Patent: Jul. 27, 2010

(54) MODULAR SETTING DIAMOND JEWELRY

(75) Inventor: Tian-Wei Lin, Shenzhen (CN)

(73) Assignee: Shenzhen Y&M Industry Co., Ltd., Shenzhen (CN)

( * ) Notice: Subject to any disclaimer, the term of this patent is extended or adjusted under 35 U.S.C. 154(b) by 0 days.

(21) Appl. No.: 11/959,620

(22) Filed: Dec. 19, 2007

(65) Prior Publication Data

US 2009/0056376 A1 Mar. 5, 2009

(30) Foreign Application Priority Data

Aug. 31, 2007 (CN) ..... 2007 1 0076738

(51) Int. Cl.
*A44C 17/02* (2006.01)

(52) U.S. Cl. ..... 63/28; 63/27

(58) Field of Classification Search ..... None
See application file for complete search history.

(56) References Cited

U.S. PATENT DOCUMENTS 496,796 A * 5/1893 Remlinger ..... 63/28
1,238,721 A * 8/1917 Birnbaum ..... 63/28
1,252,966 A * 1/1918 Suderov ..... 63/28
1,276,132 A * 8/1918 Suderov ..... 63/15
1,330,993 A * 2/1920 Whitehouse ..... 63/28
1,351,205 A * 8/1920 Birnbaum et al. ..... 63/28
1,421,339 A * 6/1922 Zalowitz ..... 63/28
2,774,231 A * 12/1956 Peterson ..... 63/28
D505,092 S * 5/2005 Kothari ..... D11/91
D505,093 S * 5/2005 Kothari ..... D11/91
D558,637 S * 1/2008 Riesenberg ..... D11/91
D568,778 S * 5/2008 Chan ..... D11/91
7,461,452 B1 * 12/2008 Kothari ..... 29/896.412
2007/0234758 A1 * 10/2007 Mehta ..... 63/28

* cited by examiner

*Primary Examiner*—Jack W. Lavinder
(74) *Attorney, Agent, or Firm*—Buchanan Ingersoll & Rooney PC

(57) ABSTRACT

A modular setting diamond jewelry includes a noble metal base with the bottom thereof being in a shape of taper. A plurality of diamond holes is defined in the top of the noble metal base for receiving diamonds therein. A protrusion is formed between each two adjacent diamond holes which locate at the circumference of noble metal base. The peripheral setting diamonds overlap against the central diamond with inner edges thereof. The outer edge of each peripheral diamond is aligned to the peripheral edge of the noble metal base. One diamond hole is defined in the center of the noble metal base, and eight diamond holes are defined around the central diamond hole. The modular setting diamond jewelry of the present invention is ready to make with low cost, since the diamond holes defined in the noble metal base and the protrusions formed between the peripheral diamond holes can install several diamonds and the diamonds together with the noble metal base form an artistic whole to have the same effect as a big grain diamond.

4 Claims, 2 Drawing Sheets

MODULAR SETTING DIAMOND JEWELRY

BACKGROUND OF THE INVENTION

1. Field of the Invention

The present invention relates to a jewelry, particularly relates to a modular setting diamond jewelry.

2. Description of the Related Art

The current diamond resource is more and more scarce. The quantity of small-scale diamond is relatively great, but the small-scale diamond is hard to meet the customer's requirement to wear a large-scale diamond. The conventional product combined with diamonds is usually made manually through bending several long claws to fix the diamonds, which is time-consuming. Furthermore, the aspect of the product depends on human's handicraft, which often results in poor aspect.

The current large-scale diamond such as more than 1 carat diamond is expensive, which cannot satisfy the demand in the low- and middle-end market. The conventional array of several diamonds around one diamond is only to show a pattern of the jewelry. However, and the array of several diamonds around one diamond cannot show the style of a whole grain diamond.

Therefore, the present technology needs to be improved and developed.

SUMMARY OF THE INVENTION

An object of the present invention is to provide a modular setting diamond jewelry which is ready to assemble without bending operation and looks like a whole grain diamond after assembly and can be mounted to any other jewelry.

To achieve the above object, a modular setting diamond jewelry includes a noble metal base with the bottom thereof being in a shape of taper. A plurality of diamond holes is defined in the top of the noble metal base for receiving diamonds therein. A protrusion is formed between each two adjacent diamond holes which locate at the circumference of noble metal base. The peripheral setting diamonds overlap against the central diamond with inner edges thereof. The outer edge of each peripheral diamond is aligned to the peripheral edge of the noble metal base.

Wherein one diamond hole is defined in the center of the noble metal base, and eight diamond holes are defined around the central diamond hole.

The modular setting diamond jewelry of the present invention is ready to make with low cost, since the diamond holes defined in the noble metal base and the protrusions formed between the peripheral diamond holes can install several diamonds and the diamonds together with the noble metal base form an artistic whole to have the same effect as a big grain diamond.

Other objects, advantages and novel features of the present invention will be drawn from the following detailed embodiment of the present invention with attached drawings, in which:

DETAILED DESCRIPTION OF THE PREFERRED EMBODIMENTS

Figure 1:
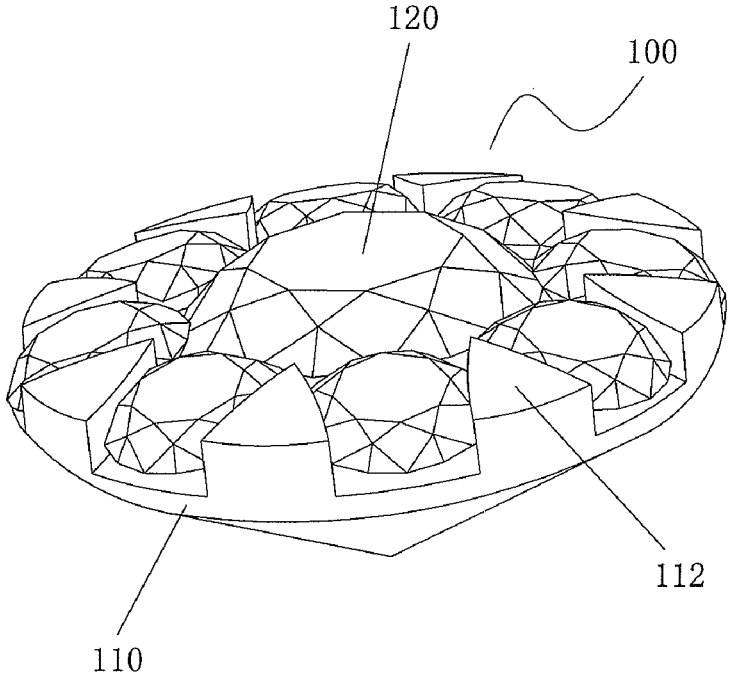
FIG. 1 is a perspective view of a modular setting diamond jewelry of the present invention.
Figure 2:
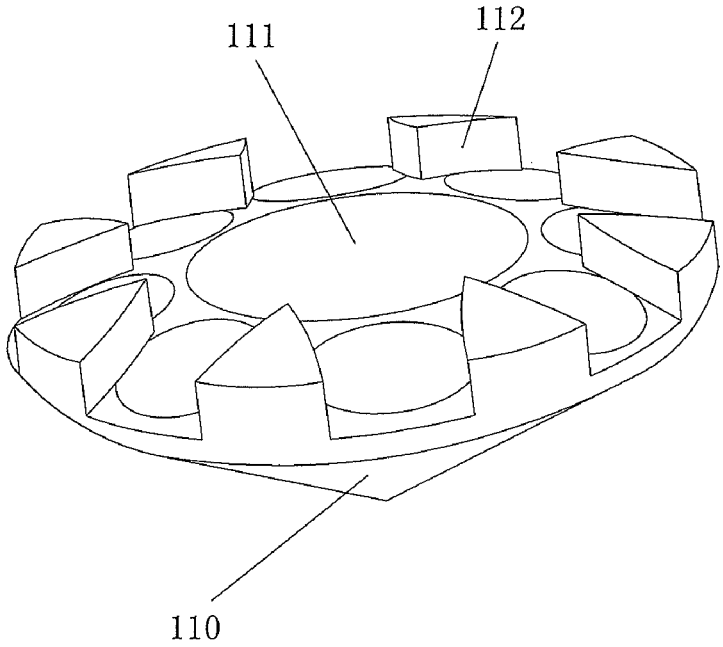
FIG. 2 is a perspective view of a noble metal base of the present invention.

Referring to FIG. 1, a modular setting diamond jewelry of the present invention includes a noble metal base 110. As shown in FIG. 2, the bottom of the noble metal base 110 is in a shape of taper. A plurality of diamond holes 111 is defined in the top of the noble metal base 110 for respectively receiving diamonds 120. The noble metal base 110 can be made by various noble metals, for example, gold, silver, platinum and alloy thereof and so on. A protrusion 112 is formed between each two adjacent diamond holes 111 which locate at the circumference of noble metal base 110. Each protrusion 112 is triangular and the protrusion 112 becomes wider outwardly along a radial direction. Thus different sizes of diamonds may be adapted to set between two protrusions 112, and does not need to manually bending a claw.

In the preferable embodiment of present invention, one diamond hole 110 is defined in the center of the noble metal base, and eight diamond holes 110 are defined around the central diamond hole 110. Of cause, the diamond holes 110 may be defined in other forms, for example, one in center, six around the center and so on. Therefore, the quantity of the diamond holes 110 of the present invention is not limited and more than one diamond holes 110 around the central diamond hole 110 can achieve the object of the present invention.

Figure 3:
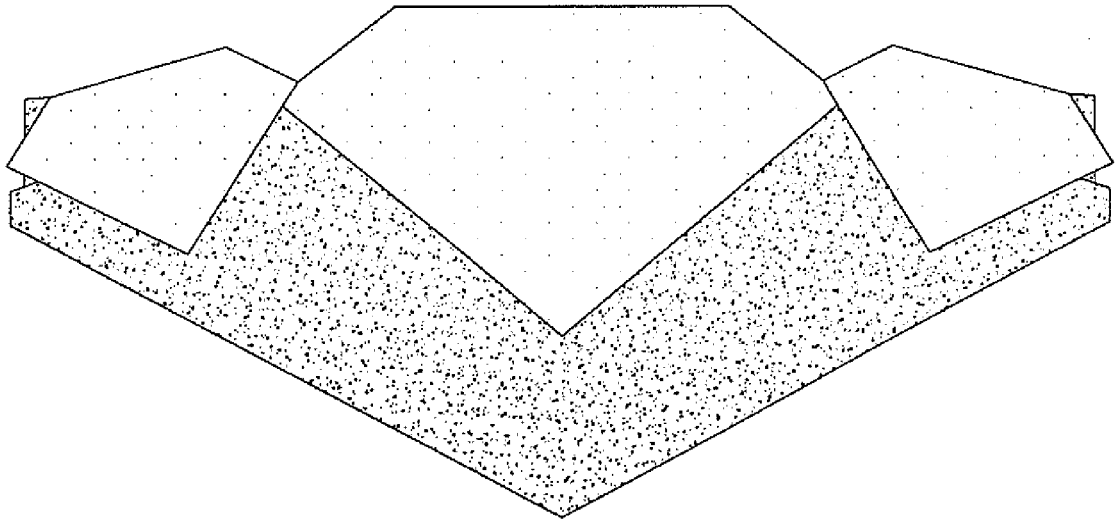
FIG. 3 is a cross-sectional view of FIG. 1.

As shown in FIG. 3, in assembly, the peripheral setting diamonds overlap against the central diamond with edges thereof. The outer edge of each peripheral diamond is aligned to the peripheral edge of the noble metal base. Moreover the bottom surface of the noble metal base is tapered. Therefore, after assemble, as a whole, the modular setting diamond jewelry resembles extremely with a whole grain diamond, but its cost reduces greatly. Thus, the modular setting diamond jewelry of the present invention can have the decoration effect of the big grain diamond with low cost.

At the same time, the modular setting diamond jewelry of the present invention can be used to completely simulate a whole grain diamond. Furthermore, the size of the modular setting diamond jewelry is changeable. So the modular setting diamond jewelry can be formed to be different standard parts thereby forming a series of product. Thus, the modular setting diamond jewelry is similar to a whole grain diamond to mount on any other jewelry, such as diamond ring, necklace and so on. Therefore, the modular setting diamond jewelry of the present invention can be as adapted to any position which the whole grain diamond is used, and so has an extremely profitable market value.

The modular setting diamond jewelry of the present invention is ready to make, since the diamond holes defined in the noble metal base and the protrusions formed between the peripheral diamond holes can install several diamonds and the diamonds together with the noble metal base form an artistic whole. The modular setting diamond jewelry of the present invention may be formed to be the series product as the single diamond to be assembled on other necklaces or the diamond ring, and has the completely same effect as a big grain diamond. Therefore, the modular setting diamond jewelry of the present invention can achieve the effect a bigger diamond with low cost and so has profitable market potential.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A modular setting diamond jewelry comprising:

a metal base with a bottom thereof being in a shape of a taper, a plurality of diamond holes being defined in a top of the metal base, one of the diamond holes defined in a center of the metal base for a central diamond, and the other diamond holes defined around the central diamond hole, for receiving peripheral setting diamonds therein;

a protrusion is formed between each two adjacent diamond holes which locate at a circumference of the metal base, for installing the peripheral setting diamonds, and the peripheral setting diamonds overlap atop the central diamond with inner edges thereof, the outer edge of each peripheral diamond being aligned to the peripheral edge of the metal base; and wherein the protrusions are equispacedly mounted in the top of the noble metal base.

2. The modular setting diamond jewelry of claim 1, wherein the protrusions protrude outwardly along a radial direction and are aligned to the peripheral edge of the metal base.

3. The modular setting diamond jewelry of claim 1, wherein the number of the protrusions is eight.

4. The modular setting diamond jewelry of claim 1, wherein each protrusion is triangular.

* * * * *